US007870675B1

(12) United States Patent
Della Polla

(10) Patent No.: US 7,870,675 B1
(45) Date of Patent: Jan. 18, 2011

(54) BEVELED BLADE FLUTE CUTTER

(76) Inventor: Michael Della Polla, 4039 Willowmere Trace, Kennesaw, GA (US) 30144

( * ) Notice: Subject to any disclaimer, the term of this patent is extended or adjusted under 35 U.S.C. 154(b) by 396 days.

(21) Appl. No.: 12/077,931

(22) Filed: Mar. 24, 2008

(51) Int. Cl.
*B26B 29/06* (2006.01)

(52) U.S. Cl. ..... 30/2; 30/294; 30/286; 30/356; 30/353

(58) Field of Classification Search ..... 30/278, 30/279.2, 294, 286, 346.55, 346.56, 353, 30/355–357, 2, 280
See application file for complete search history.

(56) References Cited

U.S. PATENT DOCUMENTS

| | | | | | |
|---|---|---|---|---|---|
| 181,918 | A | * | 9/1876 | Cushing | 30/315 |
| 920,409 | A | * | 5/1909 | Wild | 30/26 |
| 1,261,954 | A | * | 4/1918 | Newman | 30/113.3 |
| 1,431,764 | A | * | 10/1922 | Steeples | 30/353 |
| 1,757,073 | A | * | 5/1930 | Boyle | 30/286 |
| 2,279,833 | A | * | 4/1942 | Madan | 30/353 |
| 2,958,943 | A | * | 11/1960 | Koe, Jr. et al. | 30/115 |
| D191,277 | S | * | 9/1961 | Uttz | D8/18 |
| 3,543,400 | A | * | 12/1970 | McPherson et al. | 30/280 |
| 4,031,616 | A | * | 6/1977 | Hines et al. | 30/2 |
| D254,243 | S | * | 2/1980 | Florian et al. | D8/98 |
| 4,457,070 | A | * | 7/1984 | Reeves | 30/314 |
| 4,503,612 | A | * | 3/1985 | Davis | 30/2 |
| 5,411,510 | A | * | 5/1995 | Fugo | 606/166 |
| 5,561,905 | A | * | 10/1996 | Sherman | 30/280 |
| 5,568,688 | A | * | 10/1996 | Andrews | 30/29.5 |
| 5,581,887 | A | * | 12/1996 | Woodring | 30/113.1 |
| 5,581,889 | A | * | 12/1996 | Reuter | 30/142 |
| D381,886 | S | * | 8/1997 | Domenico | D8/98 |
| 5,697,157 | A | * | 12/1997 | Votolato | 30/2 |
| 5,737,842 | A | * | 4/1998 | Freedman | 30/280 |
| 5,758,423 | A | * | 6/1998 | Eversole et al. | 30/279.2 |
| 5,765,288 | A | * | 6/1998 | Hagler, Jr. | 30/280 |
| 5,890,290 | A | * | 4/1999 | Davis | 30/2 |
| 6,195,896 | B1 | * | 3/2001 | Ireland | 30/2 |
| 6,505,403 | B1 | * | 1/2003 | Andrews | 30/29.5 |
| 6,513,249 | B2 | * | 2/2003 | Linton et al. | 30/286 |
| 6,578,243 | B1 | * | 6/2003 | Hall | 24/501 |
| 6,578,266 | B2 | * | 6/2003 | Chomiak | 30/2 |
| 6,938,345 | B2 | * | 9/2005 | Yu | 30/123 |
| D540,647 | S | * | 4/2007 | Ireland | D8/98 |
| 7,353,606 | B2 | * | 4/2008 | Hudgins | 30/30 |
| D586,197 | S | * | 2/2009 | Della Polla | D8/99 |
| 7,533,595 | B2 | * | 5/2009 | Domenico | 83/13 |
| 7,540,094 | B2 | * | 6/2009 | Okada | 30/287 |
| 2002/0078572 | A1 | * | 6/2002 | Linton et al. | 30/294 |
| 2002/0194734 | A1 | * | 12/2002 | Huang | 30/2 |
| 2004/0025352 | A1 | * | 2/2004 | Vitucci | 30/123.5 |
| 2005/0235500 | A1 | * | 10/2005 | Domenico | 30/294 |
| 2006/0288587 | A1 | * | 12/2006 | Ireland | 30/294 |
| 2007/0175049 | A1 | * | 8/2007 | Goode et al. | 30/280 |
| 2007/0245572 | A1 | * | 10/2007 | Ireland | 30/294 |
| 2008/0016702 | A1 | * | 1/2008 | Domenico | 30/294 |
| 2010/0154219 | A1 | * | 6/2010 | Huett | 30/2 |

* cited by examiner

*Primary Examiner*—Kenneth E. Peterson
*Assistant Examiner*—Sean Michalski

(57) ABSTRACT

A blade shank that can be used for cutting corrugated sheets incorporating improvements to blade design and cutting geometries for an improved cutting action on corrugated sheets; that may include a handle, but does include a blade shank or blade base, at least one cutting edge, at least one guide member attached to the blade base or blade shank; the blade shank can be attached to a handle with the cutting edge facing rearward while the guide member is directed rearward wile the guide member straddles the cutting edge or edges.

10 Claims, 20 Drawing Sheets

BEVELED BLADE FLUTE CUTTER

FIELD OF THE INVENTION

The present invention relates to specialty knife blades, in particular, relates to specialty knife blades for the sign industry used for cutting and trimming corrugated plastic sheets for signs.

BACKGROUND OF THE INVENTION

Corrugated plastic sheets are used in the sign industry as a backing for signs. This material is made up of a series of flutes connected side by side to form corrugated sheets. This material can be printed on or used as a low cost backing for a sign. This material usually needs to be trimmed or cut to size. Typically a box cutter type knife with a straight edge can be used to cut against the flutes. When cutting with the flutes, an unsightly cut will result if the knife hits a sidewall of the flute causing the knife to "jump flutes". Most of the time, the flutes are not perfectly straight because of the extruded manufacturing process. They can incorporate a slight wave so it is close to impossible to cut the length of a sheet without crossing a flute wall with a standard box knife and straight edge.

This difficulty in cutting with the flutes was the need that has been filled by a "flute knife" or "flute cutter". The typical flute knife uses guide members that are attached to a blade and the blade is attached to a handle. The guide member is sized to fit into the flute of the corrugated plastic sheet. It is inserted into the flute and is used to guide the cutting blade as the user pulls the knife through the material. A second guide member, on the end of the blade is used when the user wants to cut one side of the fluted material so he can make a bend or hinge the material.

There are short comings with current flute cutter operation.

Flute cutters need an increased or disproportionate force to initially penetrate a flute wall of a corrugated sheet than the force needed to maintain the cut once started in that sheet.

Flute cutters must have the guide member go straight down the flute tube. If the guide member is not aligned in the flute tube while cutting, it presses against the top or bottom wall of the tube, increasing friction and slowing or stopping the cutting process.

The handle and guide member are at a specific angle when constructed. If the handle is not maintained at that specific angle during the cut, the guide member will press against the top or bottom wall slowing or stopping the cutting process.

Maintaining this critical angle with a traditional flute cutter is awkward and fatiguing. Many times the material is held by hand or the material is leaning against a wall while the user tries to rip its length.

Cutting thicker walled material with a larger traditional flute cutter is close to impossible. The thicker walls of the 10 mill corrugated sheet close on the blade and pinches it during a cut increasing the resistance requiring a Herculean effort by the user.

No flute cutter has a replaceable cutting blade or blade shank. Currently when the flute knife blade dulls out, it is discarded in its entirety including the handle.

There is no flute cutter that has interchangeable guide members to allow for the cutting of different size corrugated plastic sheets.

PRIOR ART

There are two flute knife designs currently being sold in volume. The first is the Saw Trax Coro Claw flute knife. It uses an ergonomically shaped grip in an elliptically shaped handle. It has a short blade shank incorporated into the plastic handle. The second flute knife is the Plast-Kut flute knife. It's blade shank runs the entire length of the knife and has plastic sides molded to the shank to form a handle area. Both knives use rivets to attach their pair of guide members to the blade shank. The angle of the guide member to handle of the two cutters is different, but both operate the same way and both must be careful to maintain the angle of handle to guide member during use.

SUMMARY OF THE INVENTION

This invention shows improvements to flute knife design and cutting geometries for an improved and easier cutting action on corrugated sheets.

The issue of increased force to initiate a cut versus maintaining the cut is addressed by staggering the cutting edge on either side of the guide member. By doing so, only one wall of the corrugated sheet is cut at a time upon entry into the corrugated sheet by the flute knife.

Guide member alignment in the corrugated material is addressed by a variable angle guide member or by using a quillion for material alignment with the guide member.

The dulling of the cutting edge of the blade shank is addressed by varying the position of the guide member on the cutting edge creating a new cutting point and/or by incorporating a separate and replaceable cutting edge while keeping the same blade shank base and same handle.

The cutting of different sized corrugated sheets is addressed with interchangeable guide members of different sizes.

The cutting of larger and thicker walled corrugated sheets is addressed by a beveled blade design that prevents the wall of the corrugated material from closing on and pinching the blade shank. Unlike a saw, that cuts a section out of a material leaving room for the blade as it cuts, a knife slices material and pushes the sides out of the way as it cuts. When cutting thicker walled corrugated plastic sheets, the wall sides of the sheet close on the knife shank as it cuts. This closing action greatly increases the friction on the knife blade and the force required to push the blade through the material. The point of beveling the blade in the guide member as it cuts a corrugated sheet is to prevent the pinching action of the cut sides on the blade shank. The bevel cut of a knife blade forces the individual flute wall side up and down on either side of the blade shank as it passes. This greatly reduces the friction and force needed to push the blade though the corrugated sheet as opposed to pinching action from cutting the sheet with the blade at a 90 degree angle.

BRIEF DESCRIPTIONS OF THE DRAWINGS

Preferred embodiments of the invention are shown in the drawings, wherein.

DETAILED DESCRIPTION OF THE EMBODIMENTS

Figure 1:
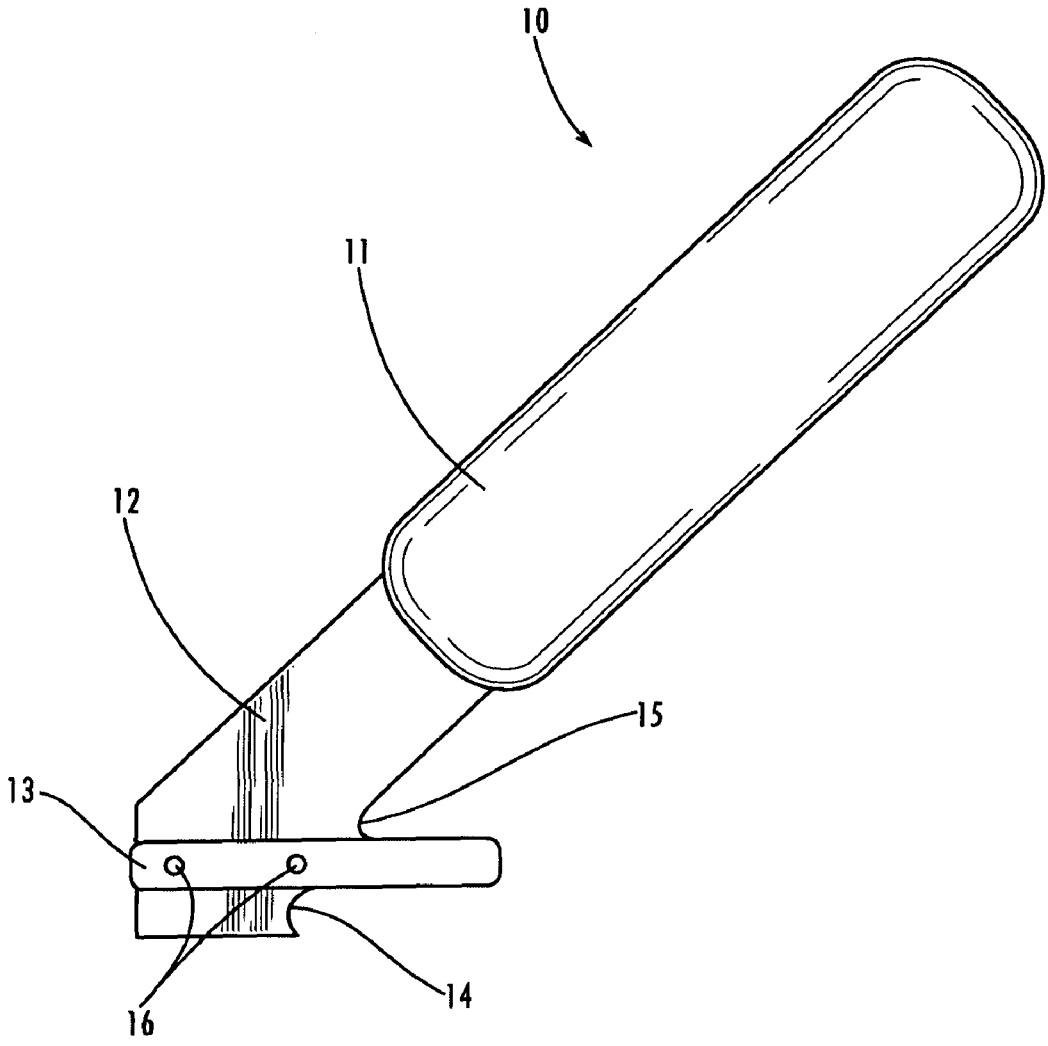
FIG. 1 is a side view of an embodiment of a blade shank.

Beginning with FIG. 1, a blade shank 10 that can include a handle 11 is shown. The handle 11 would be attached to a blade shank 12 such that the blade shank extends from the forward end of handle 11. Blade shank 12 is ground to include two staggered cutting edges, 14 and 15 on its rearward facing side. Each of cutting edges 14 and 15 have been ground on opposite sides of blade shank 12. Blade shank 12 is preferably made from spring metal or stainless steel. A guide member 13, extends beyond blade shank 12's rearward edge and is positioned between cutting edges 14 and 15. The guide member 13 can be made from metal or plastic. Fasteners 16 can be used to attach guide member 13 to blade shank 11 if guide member 13 is made of metal.

Figure 2:
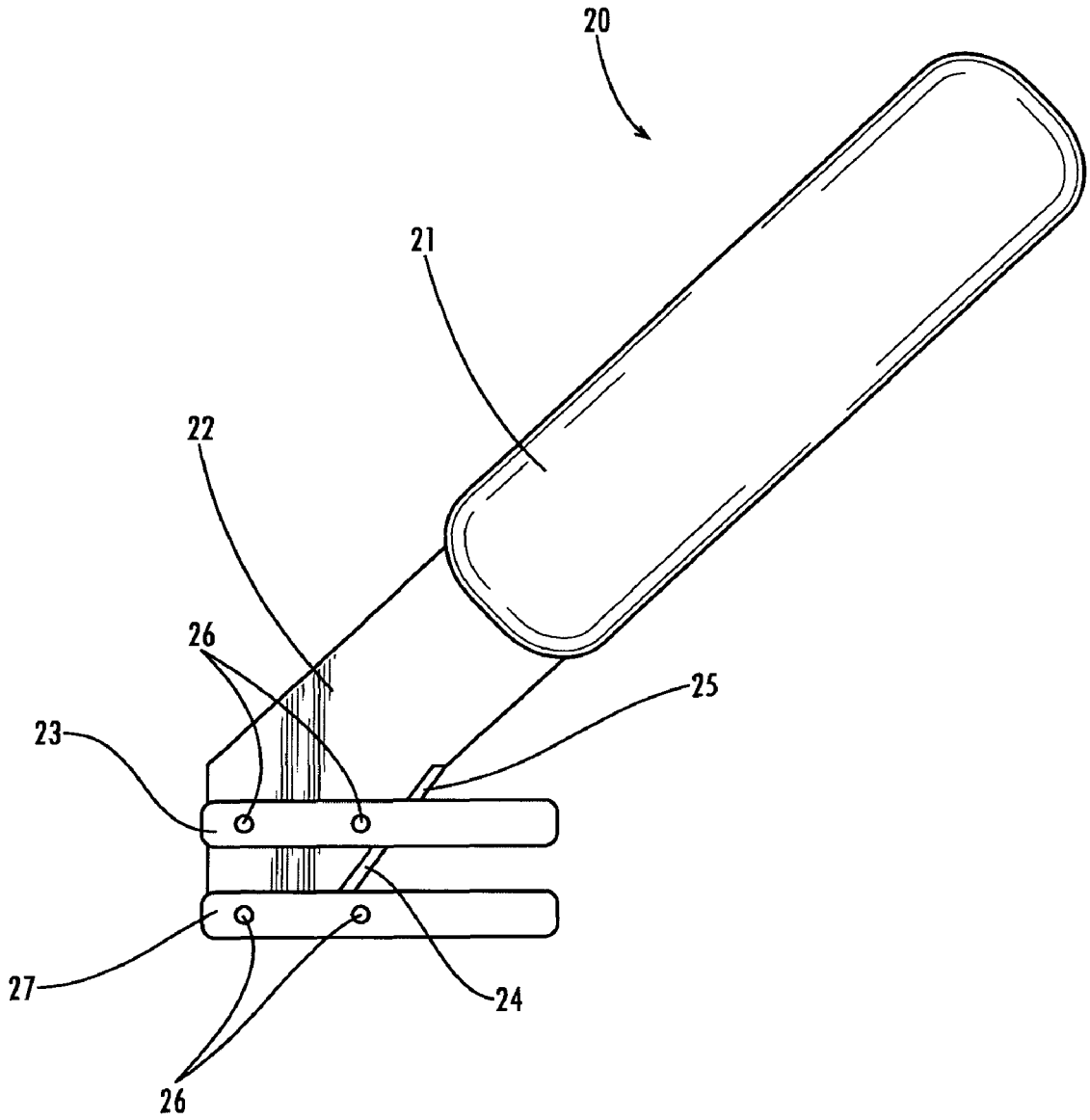
FIG. 2 is a side view of an embodiment of a blade shank showing a second guide member.

FIG. 2 shows a blade shank 20 that can include a handle 21. The handle 21 would be attached to a blade shank 22 such that the blade shank extends from the forward end of handle 21. Blade shank 21 is ground to include two staggered cutting edges, 24 and 25 on its rearward facing side. Each of the cutting edges 24 and 25 have been ground on opposite sides of blade shank 22. Blade shank 22 is preferably made from spring metal or stainless steel. A first guide member, 23, extends beyond blade shank 22 rearward and is positioned between cutting edges 24 and 25. A second guide member 27 is attached to the edge of blade shank 22 and points rearward. Second guide member 27 acts as a guard on cutting edge 24 and is used to cut a single flute wall for hinging or bending corrugated sheets. The guide members 23 and 27 can be made from metal or plastic. Fasteners 26 are used to attach guide member 23 and 27 to blade shank 21 if guide members 23 and 27 are made of metal.

Figure 3A:
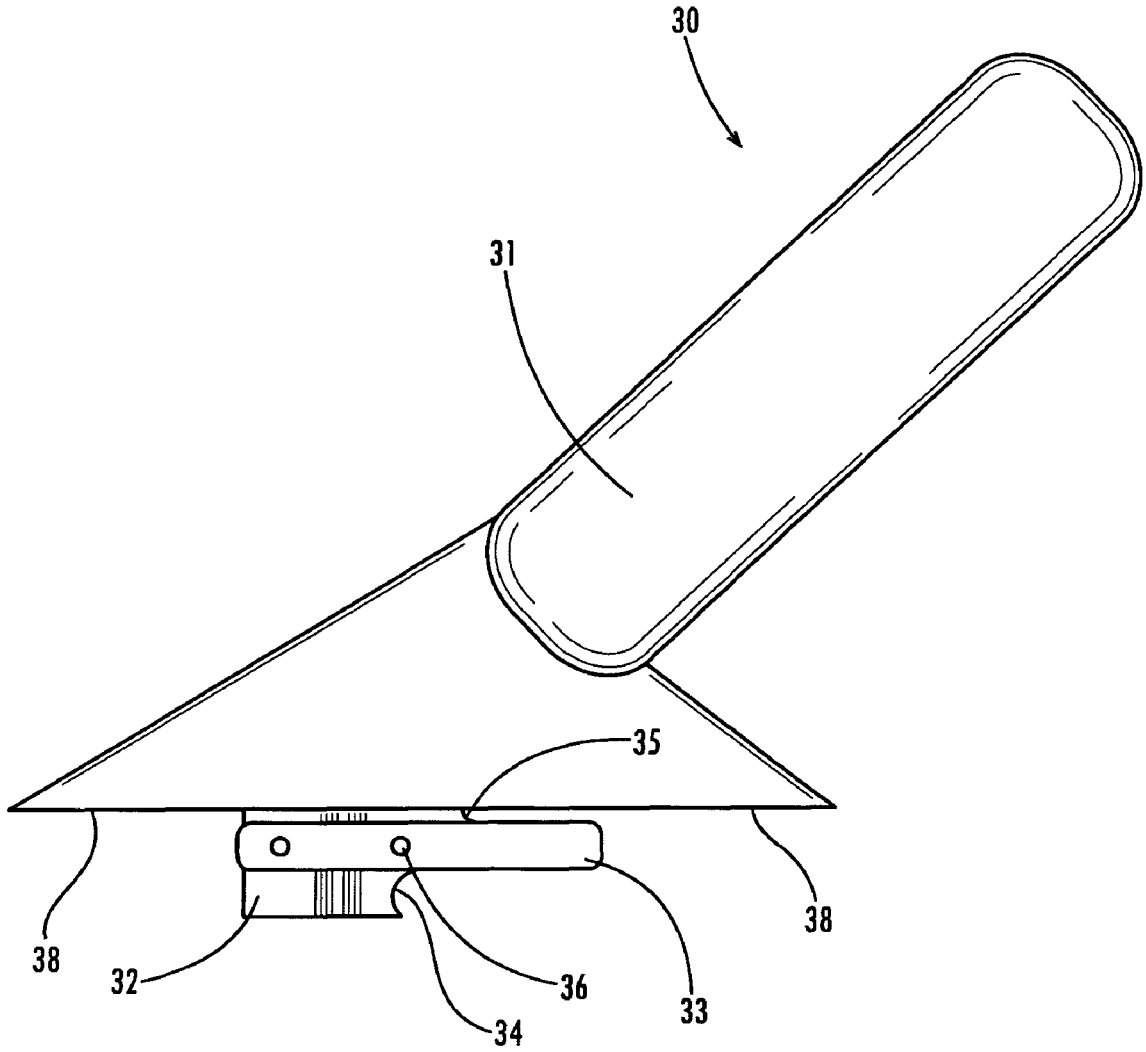
FIG. 3A is a side view of an embodiment of a blade shank showing a material guiding edge with a handle.

FIG. 3A. shows a blade shank 30 that can include a handle 31. The handle 31 can be attached to a blade shank 32 such that the blade shank extends from the forward end of handle 31. Blade shank 32 is ground to include two staggered cutting edges, 34 and 35 on its rearward facing side. Each of said cutting edges 34 and 35 have been ground on opposite sides of blade shank 32. Blade shank 32 is preferably made from spring metal or stainless steel. A guide member, 33, extends beyond blade shank 32 rearward and is positioned between cutting edges 34 and 35. The guide member 33 can be made from metal or plastic. Fasteners 36 are used to attach guide member 33 to blade shank 32. A guiding edge 38 is shown as an integral part of handle 31 or blade shank 32. When blade shank 32 is attached to handle 31, guiding edge 38 is parallel to guide member 37 and spaced from guide member 37 an amount that would leave a cutting gap slightly larger than a wall thickness of the corrugated material to be cut.

Figure 3B:
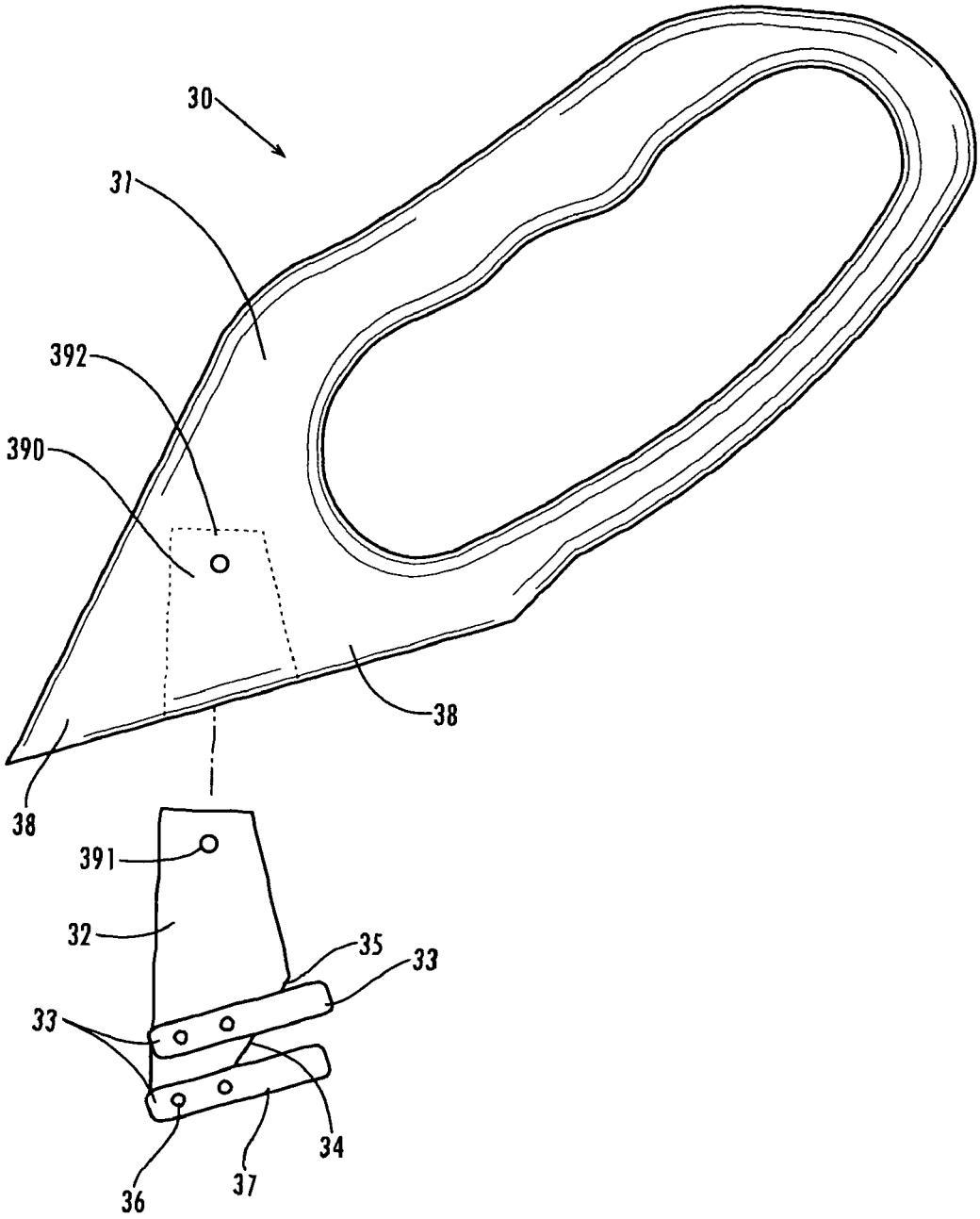
FIG. 3B is a side view of an embodiment of a blade shank showing a material guiding edge and a detachable blade shank and a different type handle.

FIG. 3B shows a blade shank 30 that can include a handle 31. The handle 31 can be attached to a detachable blade shank 32, shown separated, such that the blade shank extends from the forward end of handle 31. Blade shank 32 is ground to include two staggered cutting edges, 34 and 35 on its rearward facing side. Each of said cutting edges 34 and 35 have been ground on opposite sides of blade shank 32. Blade shank 32 is preferably made from spring metal or stainless steel. A guide member, 33, extends beyond blade shank 32 rearward and is positioned between cutting edges 34 and 35. The guide member 33 can be made from metal or plastic. Fasteners 36 are used to attach guide member 33 to blade shank 32. A second guide member 37 is attached to the edge of blade shank 32 and points rearward. Second guide member 37 acts as a guard on cutting edge 34 and is used to cut a single flute wall for hinging or bending corrugated sheets. A guiding edge 38 is shown as an integral part of handle 31. When blade shank 32 is attached to handle 31, edge 38 is parallel to guide member 37 and spaced from guide member 37 an amount that would leave a cutting gap slightly larger than a wall thickness of a corrugated material to be cut. Detachable blade shank 32 has an attaching hole 391. When attached, the base of blade shank 391 would go into a slot 390 in handle 31. A attaching hole 392 in handle 31 would line up with blade shank attaching hole 391 and a fastener, not shown would be used to attach blade shank 32 to handle 31.

Figure 4A:
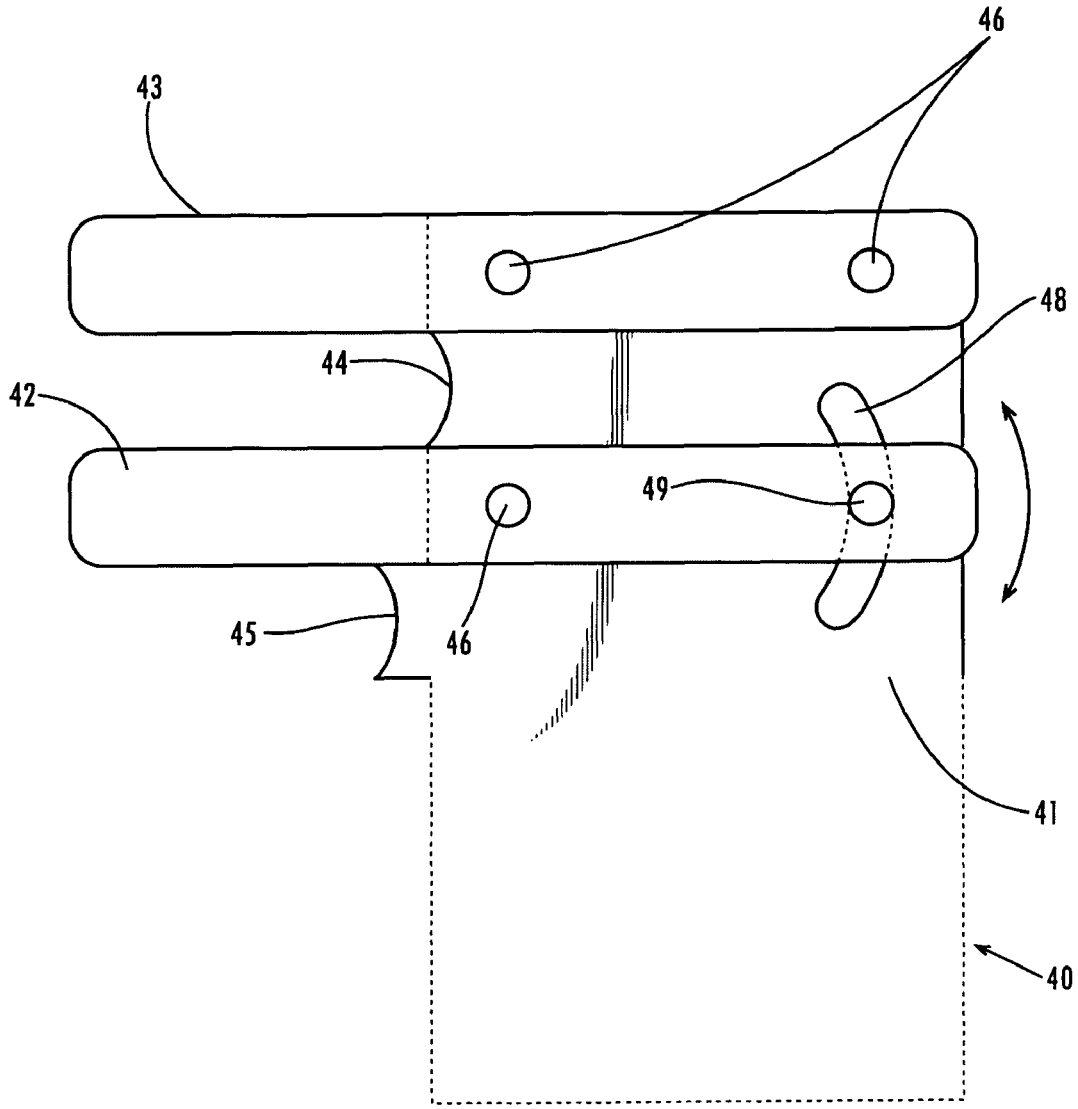
FIG. 4A is a side view of an embodiment of a blade shank showing a pivoting guide member.

FIG. 4A shows a cutting head 40 for a blade shank consisting of a blade shank 41, guide members 42 and 43, staggered cutting edges 44 and 45, fasteners 46, slot 48 in blade shank 41 and fastener 49. Guide member 42 can pivot around fastener 46 and is limited in it's travel by fastener 49 in slot 48 of blade shank 41. This pivoting action of guide member 42 expands the critical angle range between the handle and the guide member needed to keep the guide member from binding in the flute of a corrugated sheet while cutting.

Figure 4B:
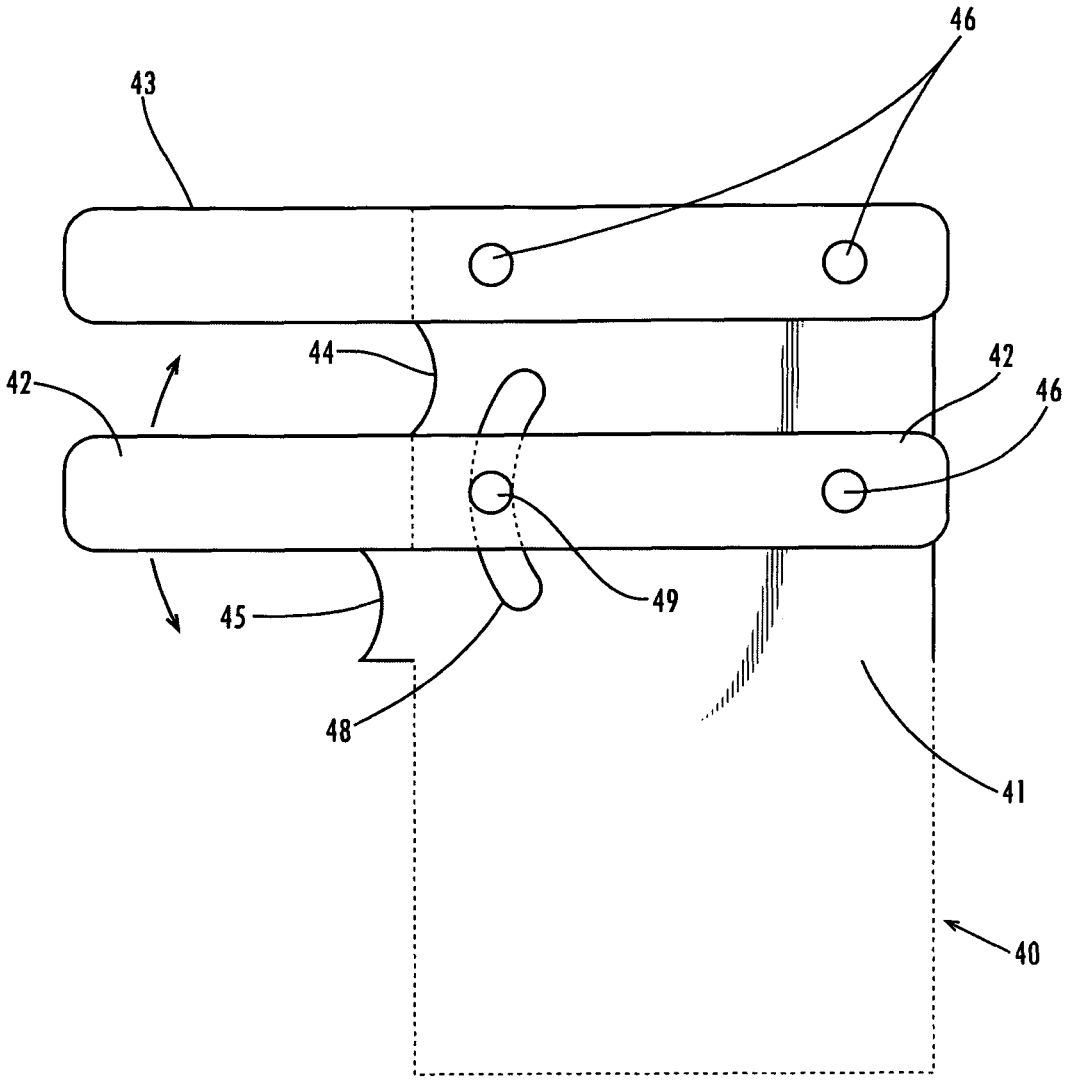
FIG. 4B is a side view of a second embodiment of a blade shank showing a pivoting guide member.

FIG. 4B shows a second embodiment of the cutting head 40 where slot 48 and fastener 49 swap positions with fastener 46 of guide member 42.

Figure 5:
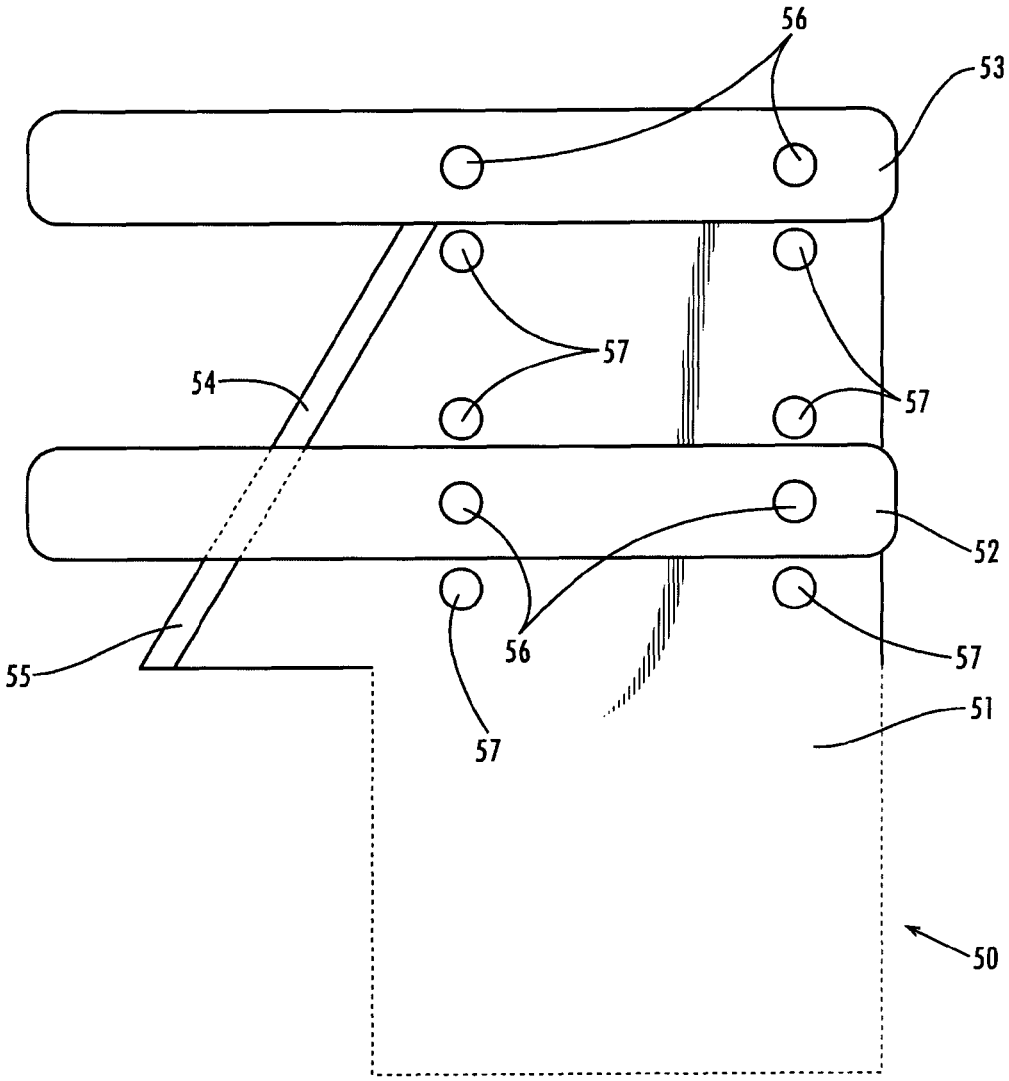
FIG. 5 is a side view of an embodiment of a blade shank showing different positions for a guide member.

FIG. 5 shows a cutting head 50 for a blade shank consisting of a blade shank 51, guide members 52 and 53, staggered cutting edges 54 and 55, fasteners 56, and alternate positioning holes 57 in blade shank 51. Guide member 52 and 53 can be repositioned on blade shank 51 by removing fasteners 56, repositioning the guide member over a different pair of alternate positioning holes 57, and reattaching the guide member with fasteners 56. This repositioning of the guide member creates a new cutting contact point on cutting edges 54 and 55, effectively replacing the cutting surface.

Figure 6A:
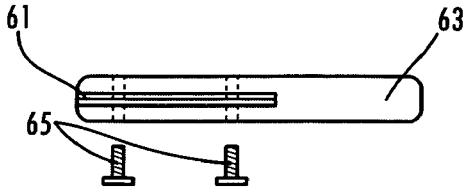
FIG. 6A is a front view of the guide member showing a slot and fasteners for attaching.
Figure 6:
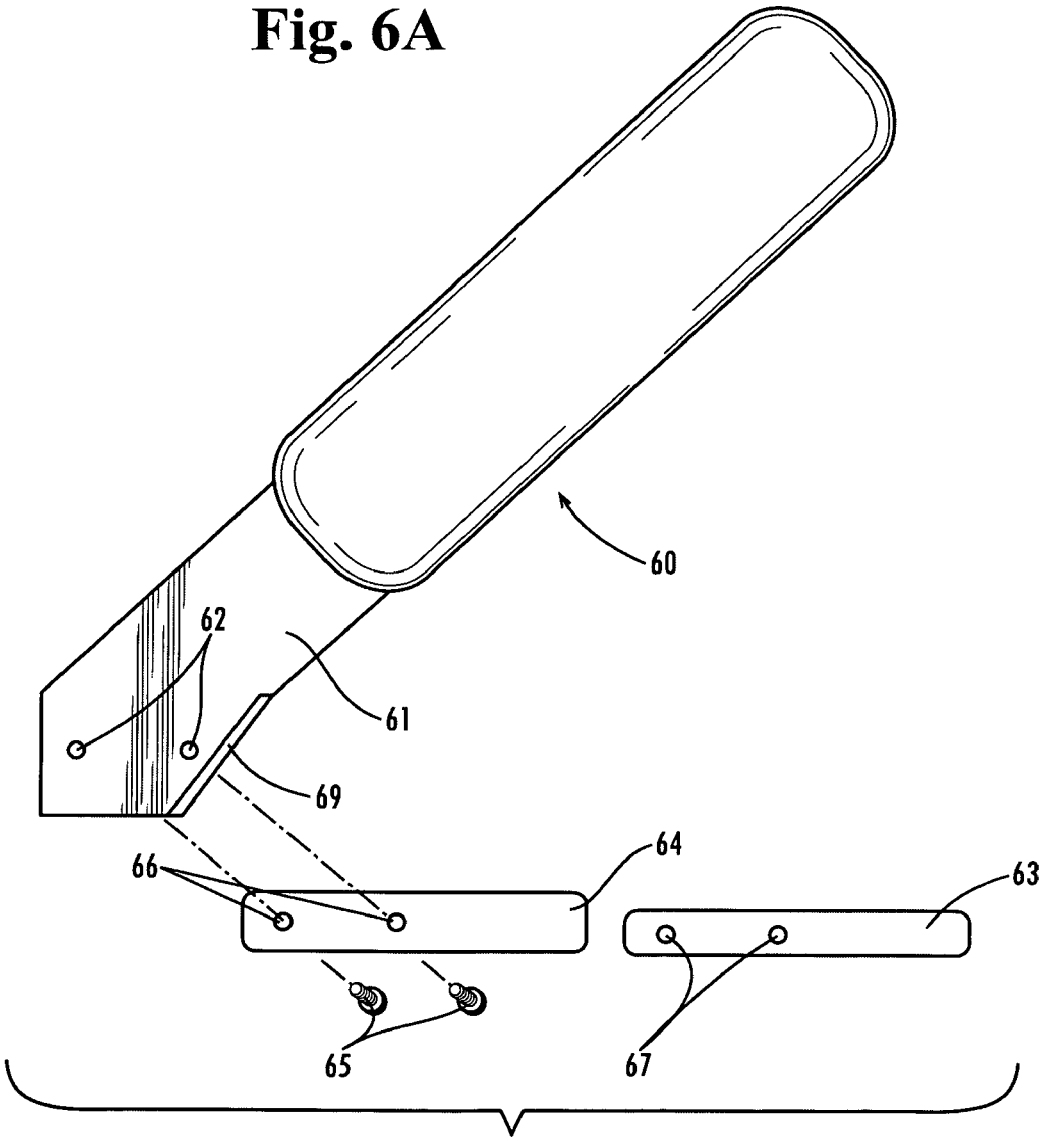
FIG. 6 is a side view of an embodiment of blade shank showing interchangeable guide members.

FIG. 6 shows an exploded side view of a blade shank 60 consisting of a blade shank 61, a replaceable guide member 64, a smaller replaceable guide member 63, a straight angled cutting edge 62, fasteners 65, mounting holes 62 of blade shank 61, guide member mounting holes 66 of guide member 64, guide member mounting holes 67 of guide member 63, a cutting edge 69 of blade shank 61. FIG. 6A shows a front view of guide member 63 showing slot 68. In operation, either guide member would insert blade shank 61 in guide member slot 68 so that guide member holes 66 or 67 line up with blade shank holes 62 so that the guide member is projecting over the cutting edge 69. Fasteners 65 attach either guide member 63 or 64 to blade shank 61 through holes 62. When attached, the guide member would point rearward extending past angled cutting edge 69. Since cutting edge 69 is angled to guide member 63 or 64, staggered cutting points of contact on cutting edge 69 are created.

Figure 7:
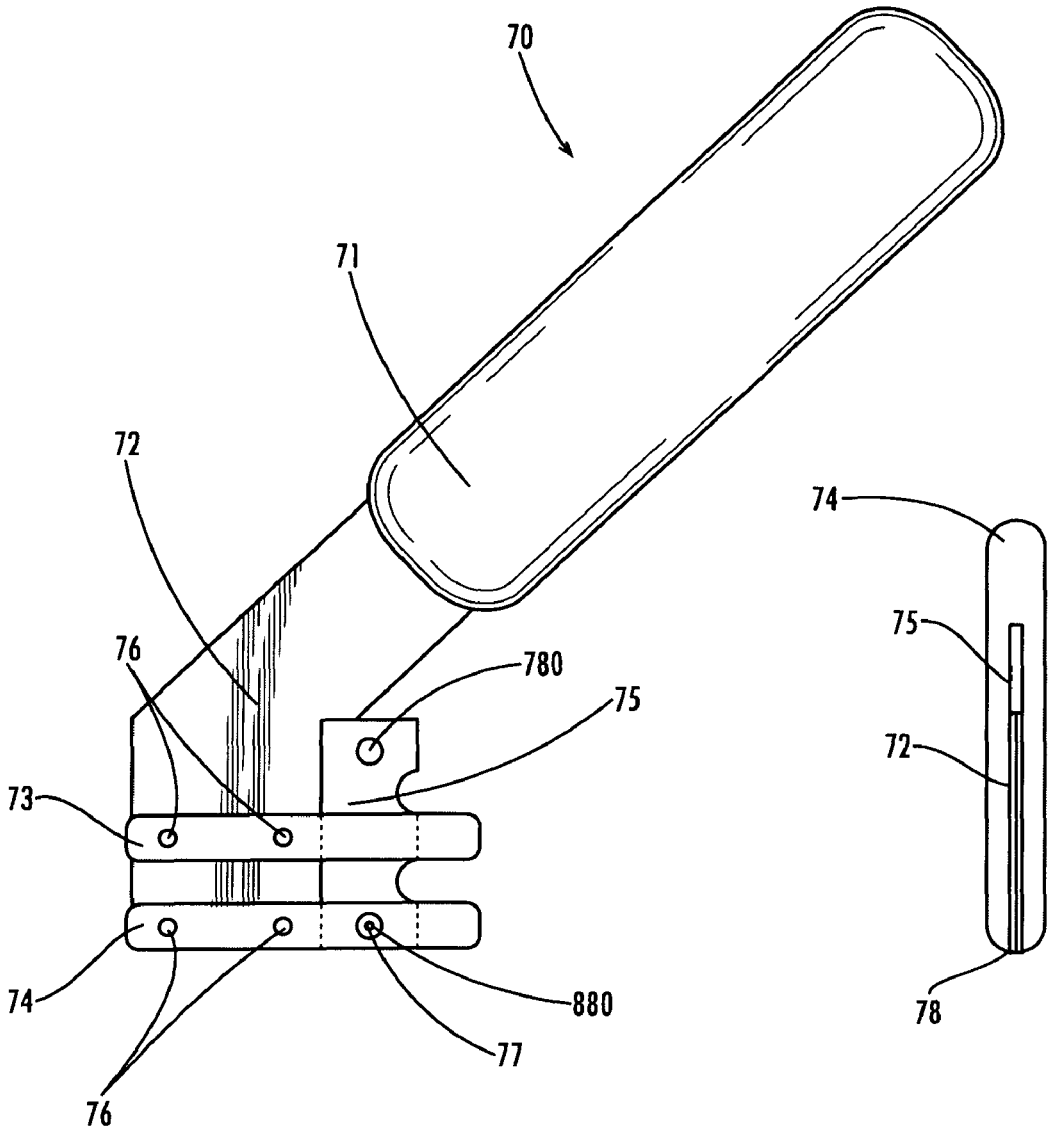
FIG. 7 is a side view of an embodiment of blade shank showing a replaceable cutting edge.

FIG. 7 shows a blade shank 70 that can include a handle 71. The handle 71 is attached to a blade base 72 such that the blade base extends from the forward end of handle 71. Blade base 71 is notched to allow for a replaceable cutting blade 75. The rearward edge side of the cutting blade 75 has been ground to create a sharp edge. A first guide member, 73, extends beyond blade base 72 and cutting blade 75, rearward and is positioned over cutting blade 75 so there are parts of the cutting blade on either side of guide member 73. A second guide member 74 is attached to the edge of blade base 72 and cutting blade 75 and creates a guard for the cutting blade. Guide member 73 and 74 can be made from metal or plastic. Fastening holes 780 in cutting blade 75 and hole 77 in second guide member 74 are aligned and fasteners 76 are used to attach guide member 73 and 74 to blade base 72 and attach cutting blade 75 to second guide member 74. A top front view is provided showing a slot 78 in guide member 74. In slot 78, the position of blade shank 72 and cutting blade 75 can be seen.

Figure 8:
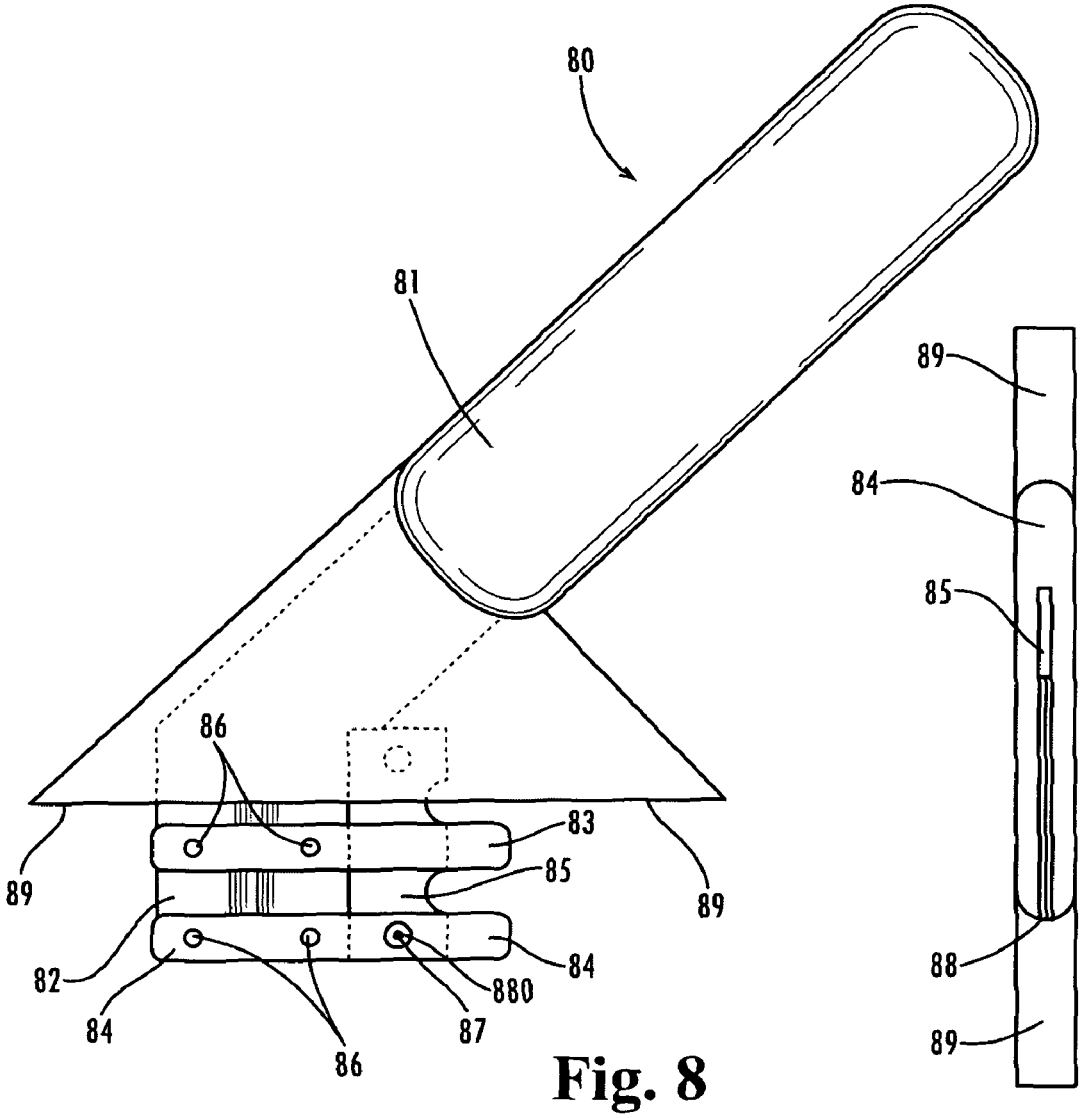
FIG. 8 is a side view of an embodiment of blade shank showing a replaceable cutting edge with a material guiding edge.

The blade shank of FIG. 8 is similar to the blade shank of FIG. 7 with the addition of a guiding edge 89. FIG. 8 shows a flute knife 80 that includes a handle 81. The handle 81 is attached to a blade base 82 such that the blade base extends from the forward end of handle 81. Blade base 81 is formed to allow for a replaceable cutting blade 85. Each rearward edge side of the cutting blade has been ground to create a sharp edge. A first guide member, 83, extends beyond blade base 82 and cutting blade 85 rearward, and is positioned over cutting blade 85 so there are parts of the cutting blade on either side of guide member 83. A second guide member 84 is attached to the edge of blade base 82 and cutting blade 85 and creates a guard for the cutting blade. Guide member 83 and 84 can be made from metal or plastic. Fastening holes 880 in cutting blade 85 and hole 87 in second guide member 84 are aligned and fasteners 86 are used to attach guide member 83, 84 to blade base 82. Fastener 87 is used to attach cutting blade 85 to second guide member 84. Guide edge 89 can be made as an extension of handle 81 or of blade base 82. It extends beyond the forward and rearward ends of guide member 83, runs parallel with guide member 83 and is spaced from guide member 83 a distance that is slightly more than a wall thickness of the corrugated sheet to be cut. Guide edge 89 helps align the non rigid corrugated sheet with guide member 83 to prevent binding of guide member 83 when cutting. A top front view is provided showing a slot 88 in guide member 84 and guide edge 89 below. In slot 88, the position of blade shank 82 and cutting blade 85 can be seen.

Figure 9A:
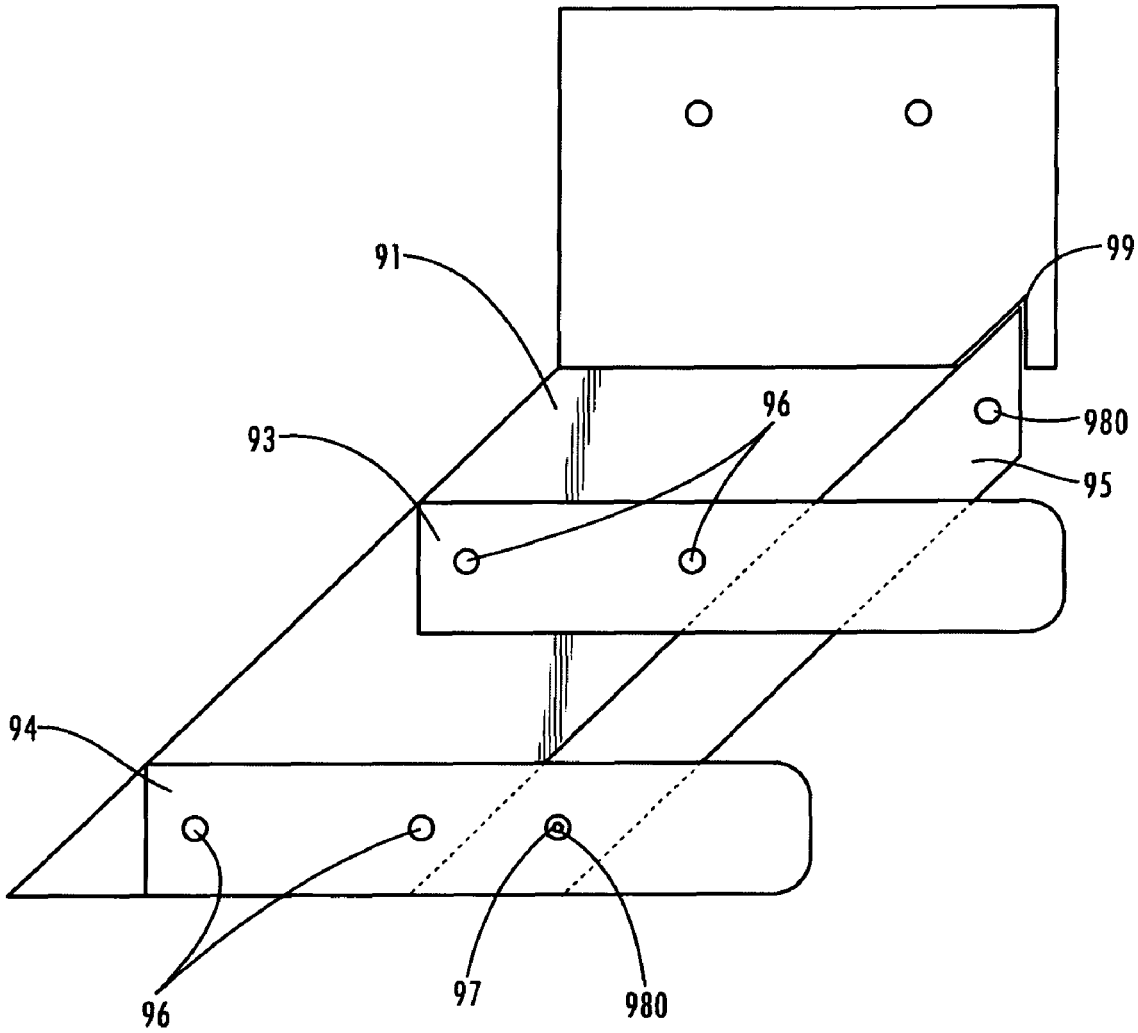
FIG. 9A is a side view of an embodiment of blade shank showing a replaceable and reversible cutting edge that is angled on different sides of the guide member.

FIG. 9A shows a blade base 91 that is formed to allow for a replaceable cutting blade 95 with a cutting edge that has staggered cutting points on a constant angled blade. Each rearward side of the cutting blade has been ground to create a sharp edge. A first guide member, 93, extends beyond blade base 92 and cutting blade 95, rearward and is positioned over cutting blade 95 so there are parts of the cutting blade on either side of guide member 93. A second guide member 94 is attached to the edge of blade base 92 and cutting blade 95 and creates a guard for the cutting blade. Guide member 93 and 94 can be made from metal or plastic. Fastening holes 980 in cutting blade 95 and hole 97 in second guide member 94 are aligned and a fastener (not shown) is used to attach member 94 and blade 95. Fasteners 96 are used to attach guide member 93, 94 to blade base 92. A second hole 980 is shown to illustrate that cutting blade 95 is reversible. A notch 99 on blade base 92 is shown and is a second holding point for cutting blade 95.

Figure 9B:
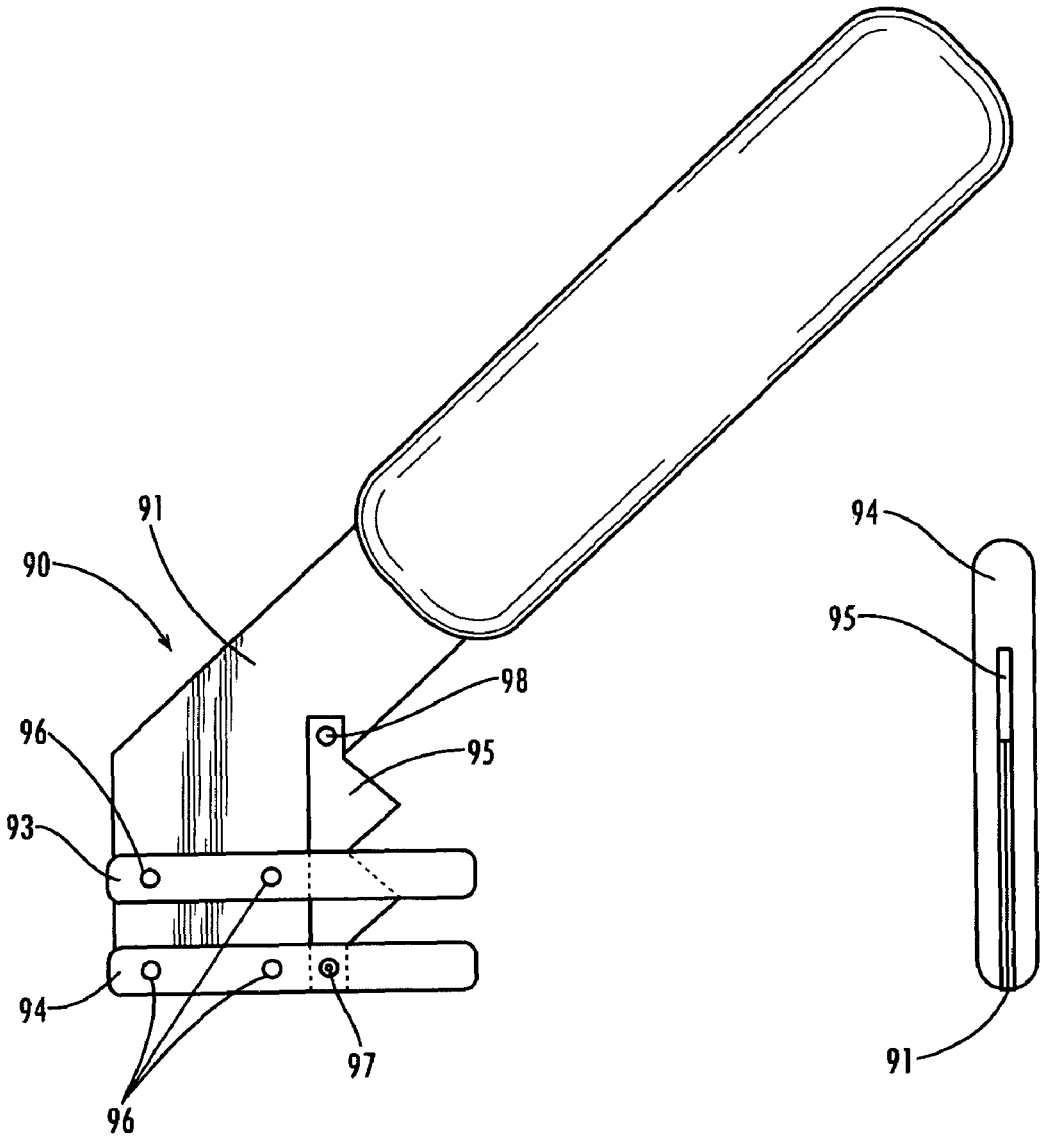
FIG. 9B is a side view of a second embodiment of blade shank showing a replaceable and reversible cutting edge that is angled on different sides of the guide member.

FIG. 9B shows a blade shank 90. Blade base 91 is formed to allow for a replaceable cutting blade 95 with a cutting edge that has staggered cutting points on a double angled blade. Each rearward edge side of the cutting blade have been ground to create a sharp edge. A first guide member, 93, extends beyond blade base 92 and cutting blade 95 rearward and is positioned over cutting blade 95 so there are parts of the cutting blade on either side of guide member 93. A second guide member 94 is attached to the edge of blade base 92 and cutting blade 95 and creates a guard for the cutting blade. Guide member 93 and 94 can be made from metal or plastic. Fastening holes 980 in cutting blade 95 and hole 97 in second guide member 94 are aligned and fasteners 96 are used to attach guide member 93, 94 to blade base 92 and attach cutting blade 95 to second guide member 94. A second hole 980 is shown to illustrate that cutting blade 95 is reversible. A notch 99 on blade base 92 is shown and is a second holding point for cutting blade 95. A top front view is provided showing a slot 98 in guide member 94. In slot 98, the position of blade shank 92 and cutting blade 95 can be seen.

Figure 10:
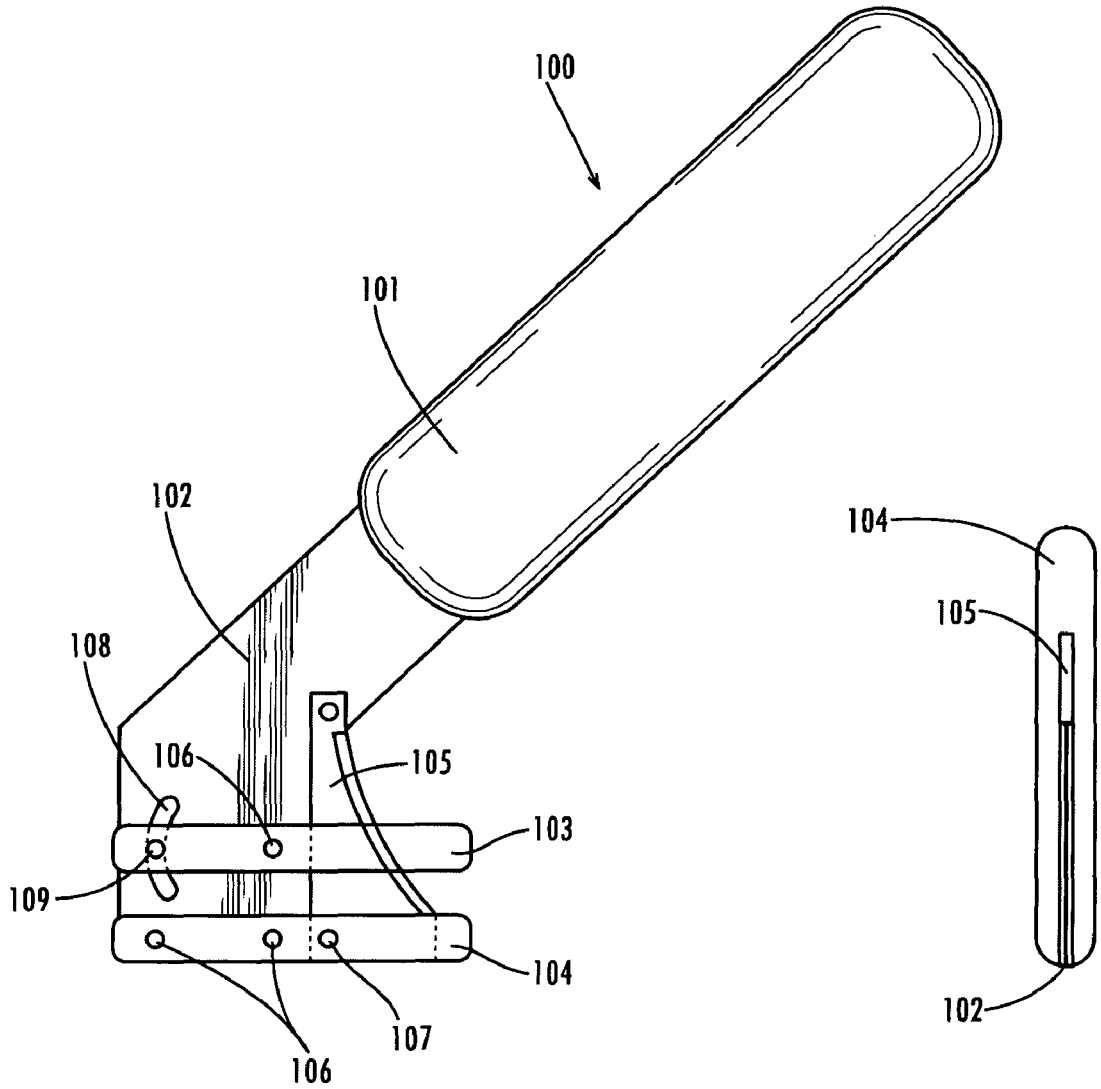
FIG. 10 is a side view of an embodiment of blade shank showing a replaceable angled cutting edge with a pivoting guide member.

The blade shank of FIG. 10 is similar to the blade shank of FIG. 7 with a pivoting first guide member 103. FIG. 10 shows a flute knife 100 that can include a handle 101. The handle 101 is attached to a blade base 102 such that the blade base extends from the forward end of handle 101. Blade base 101 is formed to allow for a replaceable cutting blade 105. The rearward edge side of cutting blade 105 has been ground to create a sharp edge and the cutting blade has a constant angle to a first guide member, 103. Guide member 103 extends beyond blade base 102 and cutting blade 105, rearward and is positioned over cutting blade 105 so there are parts of the blade on either side of guide member 103. A second guide member 104 is attached to the edge of blade base 102 and cutting blade 105 and creates a guard for the cutting blade. Guide member 103 and 104 can be made from metal or plastic. Fasten 107 in second guide member 104 is used to hold cutting blade 105 in place. Blade base 102 is slotted with a crescent shaped slot 108 at the rear of guide member 103. Fastener 109 runs through guide member 103 and slot 108 allowing the end of guide member 103 to pivot toward and away from guide member 104 and around guide member fastener 106 of guide member 103. This pivoting action helps keep guide member 103 aligned in a flute of a corrugated sheet even if the handle angle is slightly off.

A top front view is provided showing a guide member 104 and the positions of blade shank 102 and cutting blade 105 can be seen.

Figure 11:
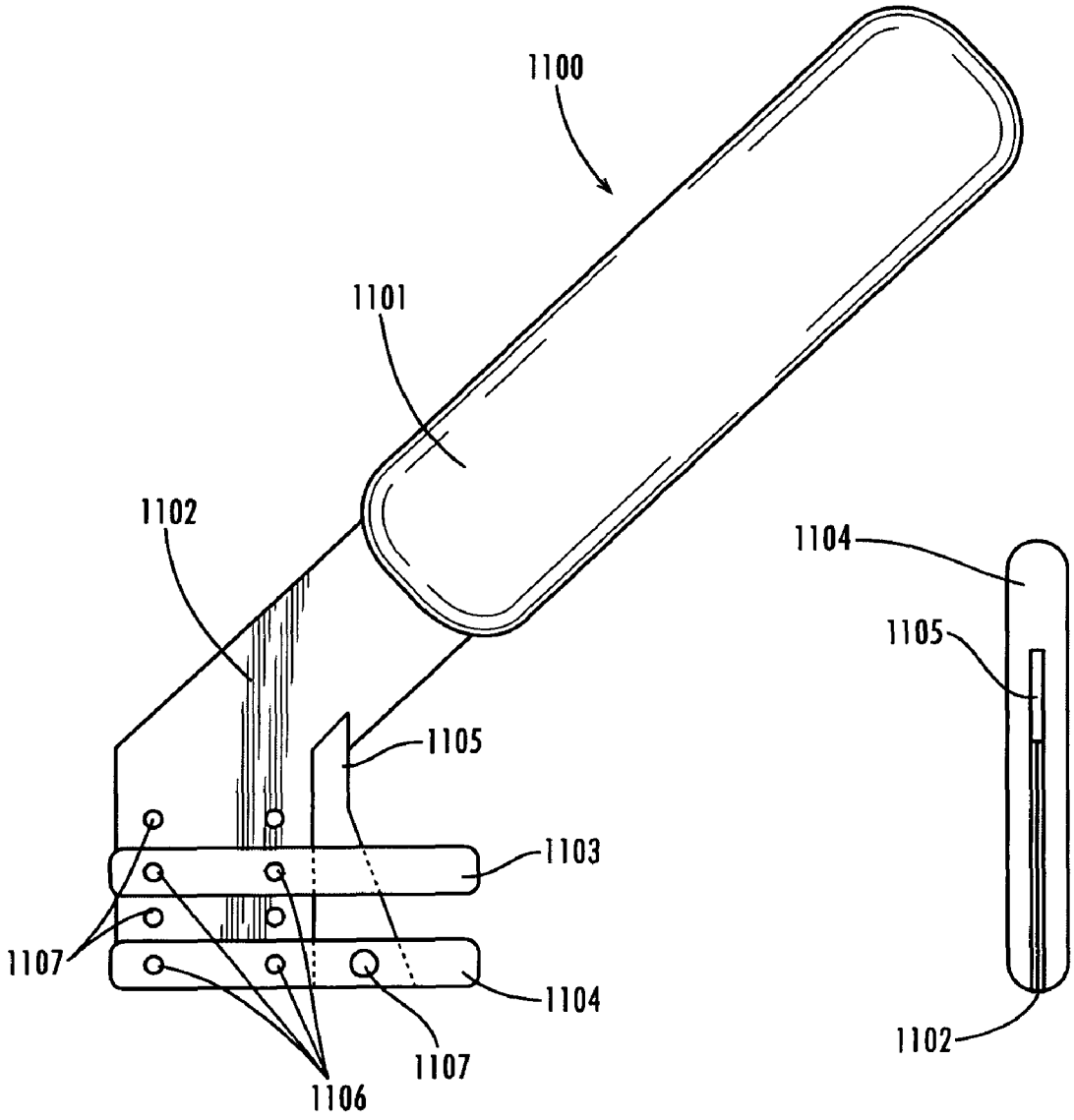
FIG. 11 is a side view of an embodiment of blade shank showing a replaceable cutting edge with a guide member that can be repositioned on the blade shank.

The blade shank of FIG. 11 is similar to the blade shank of FIG. 7 with the addition of a guide member reposition system. FIG. 11 shows a flute knife 1100 that can include a handle 1101. The handle 1101 is attached to a blade base 1102 such that the blade base extends from the forward end of handle 1101. Blade base 1102 is formed to allow for a replaceable cutting blade 1105. Each rearward edge side of the cutting blade has been ground to create a sharp edge. A first guide member, 1103, extends beyond blade base 1102 and cutting blade 1105, rearward and is positioned over cutting blade 1105 so there are parts of the cutting blade on either side of guide member 1103. A second guide member 1104 is attached to the edge of blade base 112 and cutting blade 115 and creates a guard for the cutting blade. Guide member 1103 and 1104 can be made from metal or plastic. Blade base 1102 has guide member repositioning holes 1107. Guide members use fasteners 1106 to attach to blade base 1102. Whenever a guide member is repositioned, a new sharp cutting point is created increasing the life of cutting blade 1105.

Figure 12A:
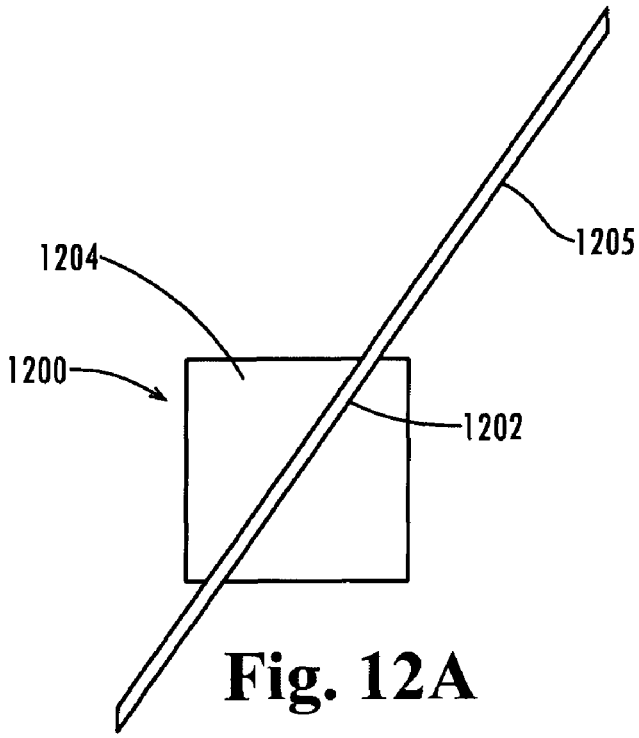
FIG. 12A is a top view of a beveling blade in a guide member.

FIG. 12A is a front view of a cutting head 1200 that can be used for cutting corrugated plastic sheets consisting of a blade shank 1202 and a guide member 1204. Guide member 1204 can be made of plastic or metal material and can be attached to blade shank 1202 by fasteners or by injected molding. Blade shank 1202 is partially encased in guide member 1204 at an angular axis, instead of at a 90 degree axis. Blade shank 1202 has an extended side 1205 that can be used for holding or as an attaching point for a handle. Guide member 1204 is of such a cross section as to be just smaller than the flute hole of a corrugated sheet it is to be used with. When guide member 1204 is inserted into a flute of a corrugated sheet, it guides blade shank 1202 through the sheet at a bevel angle to the sheet so the sheet walls are cut at the same bevel angle as the bevel angle of blade shank 1202 in guide member 1204.

Figure 12B:
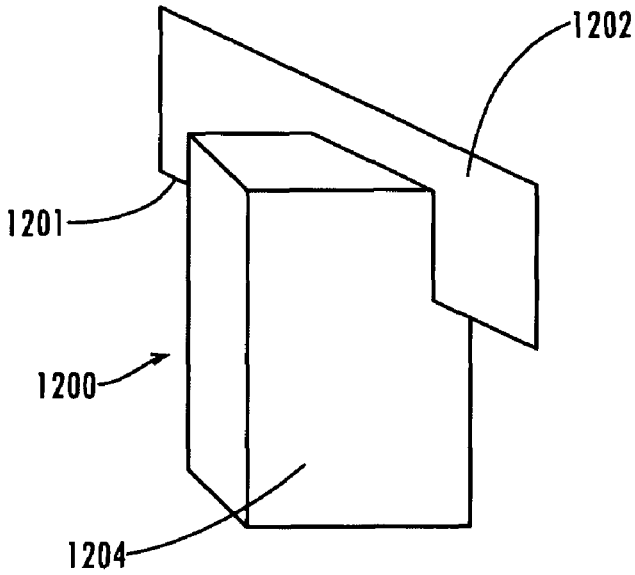
FIG. 12B is a side perspective view of a beveling blade in a guide member.

FIG. 12B shows a side perspective angle of cutting head 1200. A cutting edge 1201 is shown at the bottom of blade shank 1202. This cutting edge can be ground or sharpened so it is sharp enough to slice through the corrugate sheet.

Figure 13:
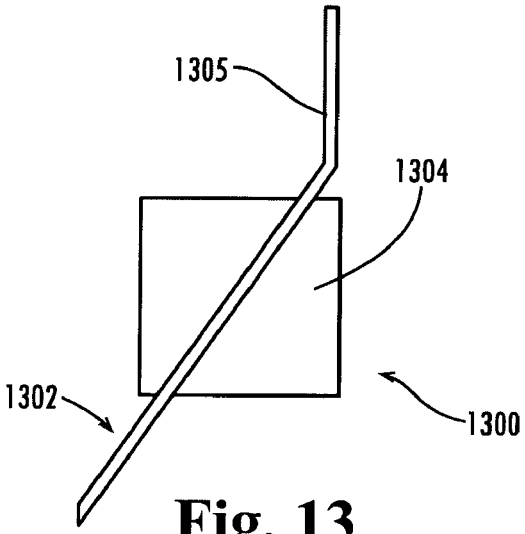
FIG. 13 is a top view of a beveling blade in a guide member that has a bend allowing a handle to be at a right angle to the side of the guide member.

FIG. 13 is similar to FIG. 12 with the addition of a bend in blade shank 1302 creating a handle section, 1305, to maintain a 90 degree angle to the sheet while cutting. FIG. 13 is a front view of a cutting head 1300 that can be used for cutting corrugated plastic sheets consisting of a blade shank 1302 and a guide member 1304. Guide member 1304 can be made of plastic or metal material and can be attached to blade shank 1302 by fasteners or by injected molding. Blade shank 1302 is partially encased in guide member 1304 at an angular axis instead of at a 90 degree axis. Blade shank 1302 has a bend outside the guide member forming side 1305. Side 1305 can be used for holding or as an attaching point for a handle. Blade shank side 1305 forms a 90 degree angle to the guide member. Guide member 1304 is of such a cross section as to be just smaller than the flute hole of a corrugated sheet it is to be used with. When guide member 1304 is inserted into a flute of a corrugated sheet, it guides blade shank 1302 through the sheet and at a bevel angle to the sheet so the sheet walls are cut at the same bevel angle as the bevel angle of blade shank 1302 in guide member 1304.

Figure 14:
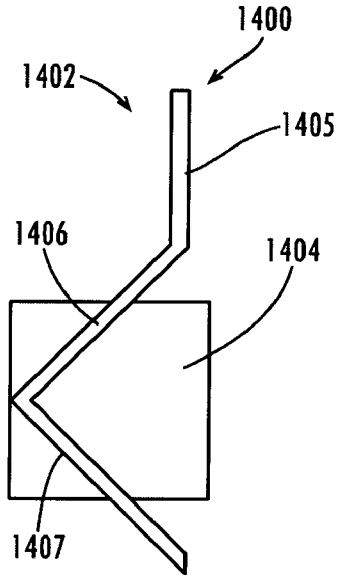
FIG. 14 is a top view of a beveling blade in a guide member with multiple bends to bevel cut in opposite directions on opposing sides of the guide member.

FIG. 14 is similar to FIG. 13 with the addition of a bend in a section of blade shank 1402 that is encased by guide member 1404, creating sides 1406 and 1407. FIG. 14 is a front view of a cutting head 1400 that can be used for cutting corrugated plastic sheets consisting of a blade shank 1402 and a guide member 1404. Guide member 1404 can be made of plastic or metal material and can be attached to blade shank 1402 by fasteners or by injected molding. Blade shank 1402 has two sides 1406 and 1407, encased in guide member 1404. Sides 1406 and 1407 are at an angular axis to the sides of guide member 1404 instead of at a 90 degree axis creating a opposite angled bevel angle on either side of guide member 1404. Blade shank 1402 has a bend outside the guide member forming side 1405. Side 1405 can be used for holding or as an attaching point for a handle. Blade shank side 1405 forms a 90 degree angle to the guide member. Guide member 1404 is of such a cross section as to be just smaller than the flute hole of a corrugated sheet it is to be used with. When guide member 1404 is inserted into a flute of a corrugated sheet, it cuts with blade shank sides 1406 and 1407 at a bevel angle so the sheet walls are cut at an opposing bevel angle of its outer wall sides.

Figure 15:
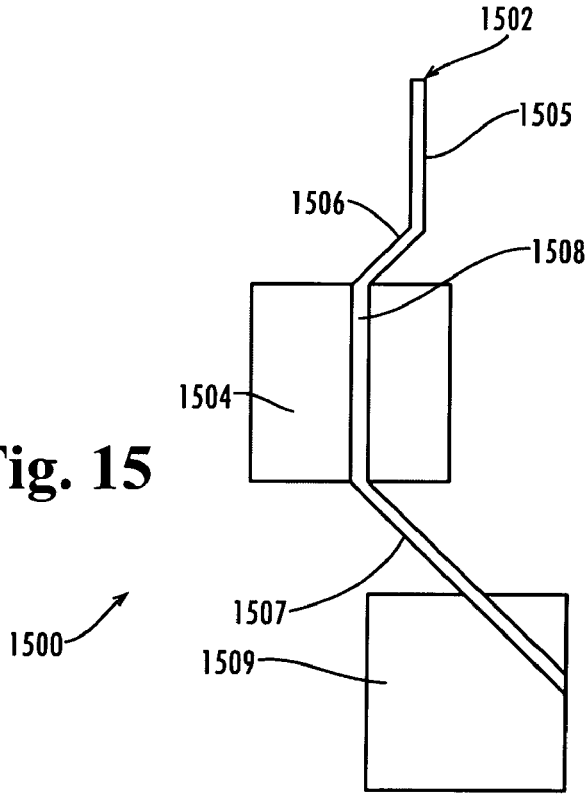
FIG. 15 is a top view of a beveling blade in a guide member with multiple bends to bevel cut in opposite directions on opposing sides of the guide member with a second guide member attached to the end of the blade.

FIG. 15 is similar to FIG. 14 with the addition of a bend in a section of blade shank 1502 that is encased by guide member 1502, creating side 1508 and the addition of a second guide member at the end of blade shank 1502. FIG. 15 is a front view of a cutting head 1500 that can be used for cutting corrugated plastic sheets consisting of a blade shank 1502 and a first guide member 1504. First guide member 1504 can be made of plastic or metal material and can be attached to blade shank 1502 by fasteners or by injected molding. A second guide member, 1509, is attached at the end of blade shank 1502 on side 1507. Guide member 1509 runs parallel to guide member 1504, acts as a guard to side 1507, is made out of the same material and attached in the same manner as guide member 1504. Blade shank 1502 has a side 1508, encased in guide member 1504 and is perpendicular to the top and bottom sides of guide member 1504. Sides 1506 and 1507 join with side 1508 and are at opposing angles to side 1508. Blade shank 1502 has a bend outside guide member 1504 forming side 1505. Side 1505 can be used for holding or as an attaching point for a handle. Blade shank side 1505 forms a 90 degree angle to its side of guide member 1504. Guide member 1504 and 1509 are of such a cross section as to be just smaller than the flute hole of a corrugated sheet it is to be used with. When guide member 1504 is inserted into a flute of a corrugated sheet, the blade shank sides 1506 and 1507 cut through the sheet at beveled angles to the sheet so the sheet walls are cut at opposed bevel angles.

Figure 16:
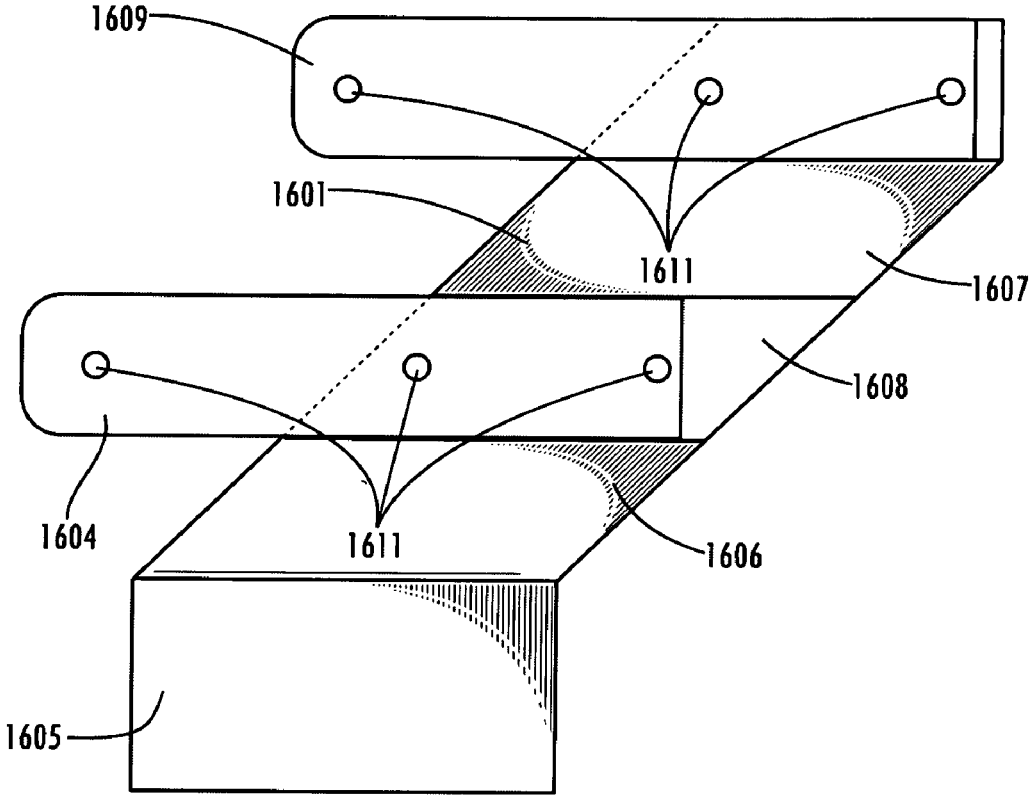
FIG. 16 is a side view of a beveling and angled blade shank.

FIG. 16 is a side view of a cutting head 1600 similar to the one in FIG. 15 with an addition of a bend to form side 1610 at the end of side 1607. Side 1610 is parallel with side. This side view shows cutting sides 1606 and 1607 have staggered cutting edges because of their angle to guide members 1604 and 1609. This staggering of the cutting edges on either side of guide member 1604 makes the initial blade entry into a corrugated sheet easier because one side is entering the sheet at a time as opposed to both sides at the same time. FIG. 16 shows fasteners 1611 used to attach guide members 1604 and 1609 to blade shank 1602.

Figure 17:
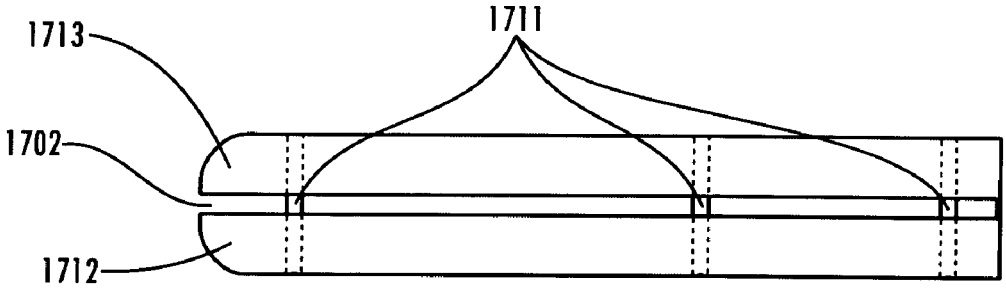
FIG. 17 is a front view of a blade shank showing independent sides of a guide member attached to the blade shank.

FIG. 17 is a front view of an embodiment a cutting head 1700 that would have independent sides to each guide member. Independent side 1712 and 1713 are held to blade shank 1702 with fasteners 1711.

Figure 18A:
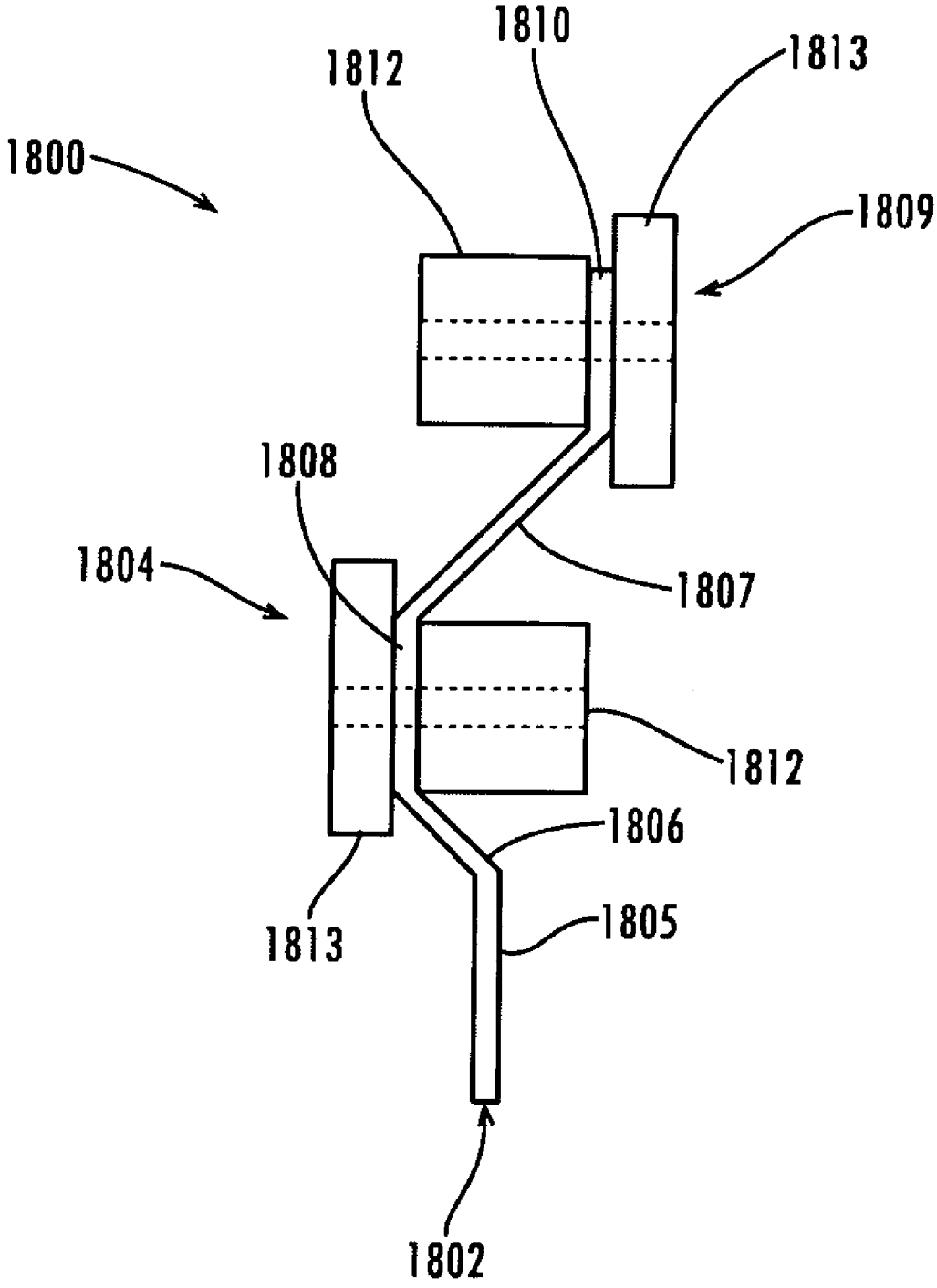
FIG. 18A is a top view of a beveling blade shank that has different sized independent sides and their position on the blade shank.

FIG. 18A is a front view of a cutting head 1800 showing the different height and width of guide member sides 1812 and 1813 on cutting head 1800. Blade shank 1802 is made up of sides 1805, 1806, 1807, 1808 and 1810. Guide member 1804 is made up of guide member sides 1813 and 1812 and blade shank side 1808 held together by fastener 1811 (not shown). Guide member 1809 is made up of guide member sides 1813 and 1812 and blade shank side 1810 held together by fastener 1811 (shown by dashed lines). By varying the height and width of guide member sides 1812 and 1813 or by varying the angle of sides 1806 and 1807 to side 1808 and 1810, a cut in a specific place on the outer top and bottom walls of a corrugated sheet can be made. For instance, a specific cutting location in the center of the top and bottom flute walls or a cutting location at the top and bottom flute walls next to an inner side flute wall can be designed.

Figure 18B:
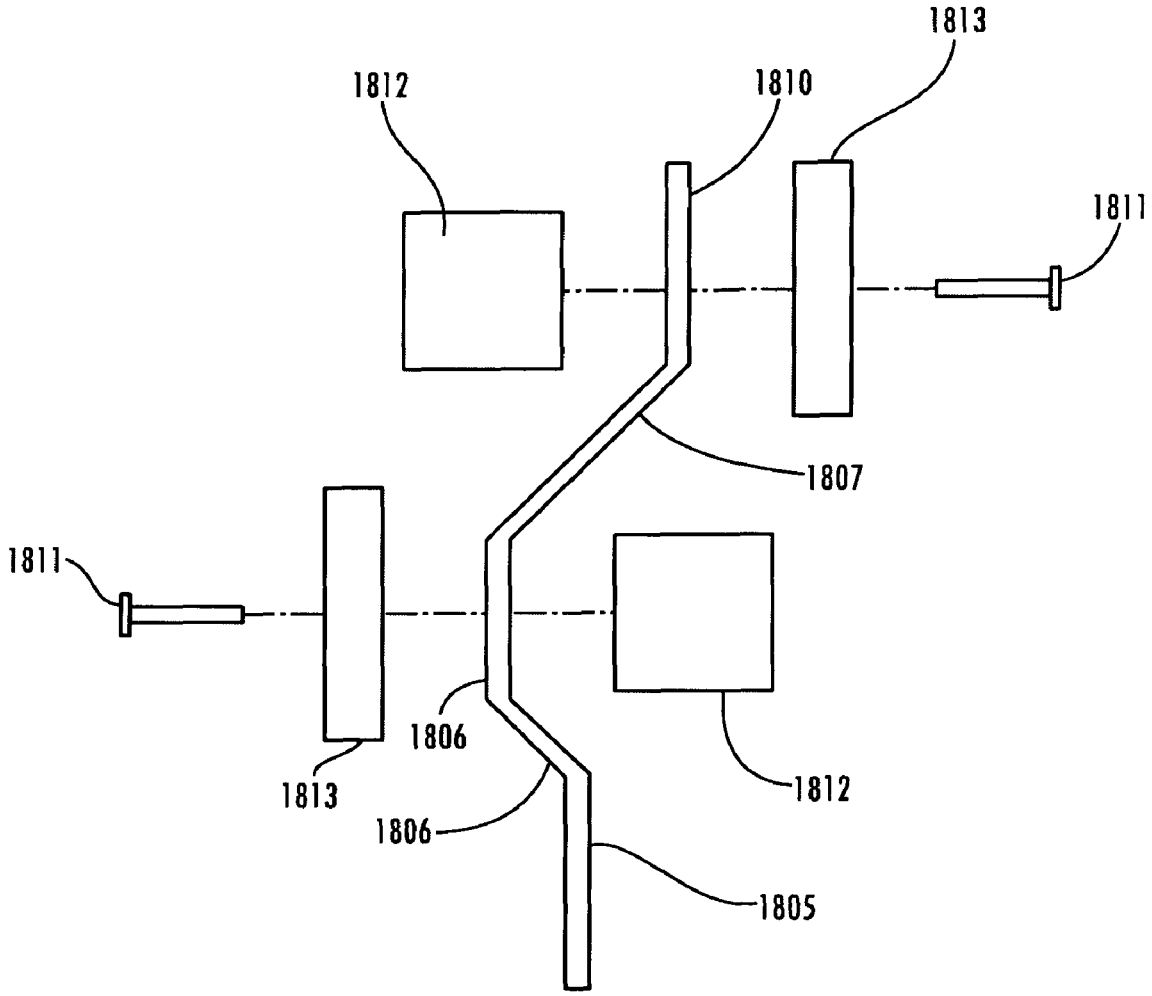
FIG. 18B is an exploded top view of a beveling blade shank that has different sized independent sides and the fasteners to attach them.

FIG. 18B is an exploded view of FIG. 18A showing parts of cutting head 1800 including fasteners 1811.

Figure 19:
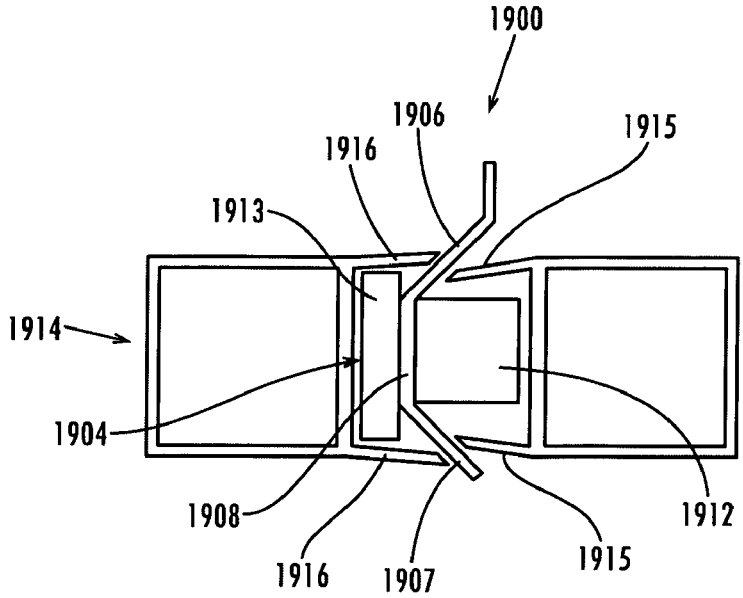
FIG. 19 is a top view of a beveling blade shank in a corrugated sheet during a cut showing what happens to the cut walls of the corrugated sheet.

FIG. 19 is a view looking down the guide member 1904 of cutting head 1900 inside a flute of a corrugated sheet 1914 during a cut. Guide member 1904 is made up of guide member sides 1913 and 1912 and blade shank side 1908. Cutting edges 1906 and 1907 cut sheet 1914 so that flute wall sections 1915 is pushed inward toward guide member side 1912 and flute wall section 1916 is pushed outward creating a non-pinching slice for cutting edges 1906 and 1907.

Figure 20:
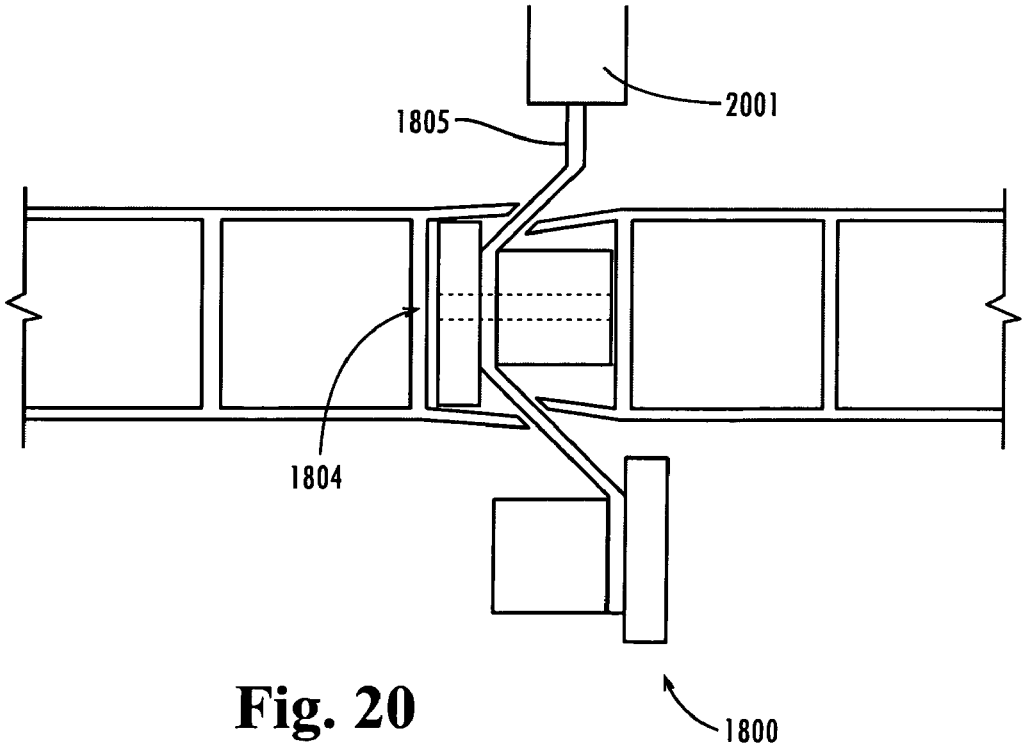
FIG. 20 is a top view of a beveling blade shank in a handle in a corrugated sheet during a cut showing how the sizing of the independent sides can position the cut in the flute of the corrugated sheet.

FIG. 20 shows a view down guide member 1804 of cutting head 1800 while in a corrugated sheet including a handle 2001 attached to part 1805 of cutting head 1800.

The embodiments of a corrugate blade which an exclusive property or privilege is claimed are defined as follows:

1. A blade used for cutting corrugated sheets comprising: a blade unit including a planar blade shank portion defining a plane, a first transition point where the blade unit bends out of the plane to form a first cutting edge (35) and a second transition portion where the blade unit bends out of plane and is embedded in a discrete first guide member; a third transition point where the blade unit bends out of plane to form a second cutting edge at an angle diverse from the blade shank portion and the first cutting edge;

said first elongated guide member (33) partially encasing the blade unit below the first cutting edge and extending to both lateral sides and in front of the first cutting edge of the blade unit;

a second elongated guide member partially encasing the blade unit below the second cutting edge and extending to both lateral sides and in front of the second cutting edge of the blade unit;

the first and second guide members having top and bottom surfaces perpendicular to the plane of the planar blade shank portion so that the first and second cutting edges of the blade shank are angled to create beveled cuts when the blade is drawn through a corrugated sheet.

2. A blade used for cutting corrugated sheets comprising: a blade unit including a planar blade shank portion defining a plane, a first transition point where the blade unit bends out of the plane to form a first cutting edge (35) and a second transition portion where the blade unit bends out of plane and is embedded in a discrete first guide member; a third transition point where the blade unit bends out of plane to form a second cutting edge at an angle diverse from the blade shank portion and the first cutting edge;

said first elongated guide member (33) partially encasing the blade unit below the first cutting edge and extending to both lateral sides and in front of the first cutting edge of the blade unit;

a second elongated guide member partially encasing the blade unit below the second cutting edge and extending to both lateral sides and in front of the second cutting edge of the blade unit;

the first guide member having top and bottom surfaces parallel to a top surface of the second guide member so that the cutting edges of the blade shank are angled to the corrugated sheet and create top and bottom differently angled beveled cuts when the blade is drawn through a corrugated sheet.

3. A blade as in claim 2 or 1, wherein the guide members are pivotally mounted to the blade unit.

4. A blade as in claim 2 or 1, wherein the cutting edges are mounted to the blade unit such that they may be replaced.

5. A blade as in claim 2 or 1, wherein each of the guide members may be repositioned on the blade unit.

6. A blade as in claim 2 or 1, wherein each of the guide members may be replaced by different guide members of a different width.

7. A blade as in claim 2 or 1, wherein the second cutting edge trails the first cutting edge.

8. A blade as in claim 2 or 1, wherein each guide member is formed of multiple guide member sides fastened to either side of the blade unit.

9. A blade shank as in claim 8 where one side of the guide member side is larger than the opposing smaller side of the guide member side, the smaller side being smaller than the larger side by an amount at least twice as much as the wall thickness of the corrugated material being cut.

10. A blade shank as in claim 8 where the independent guide member sides are of a size that puts the cutting edge of each cutting side at the approximate mid point of the flute being cut in the corrugated sheet.

* * * * *